United States Patent [19]

Akiike et al.

[11] Patent Number: 4,944,158

[45] Date of Patent: Jul. 31, 1990

[54] METHOD OF DEFROSTING A REFRIGERATING CIRCUIT FOR USE IN COOLING A VEHICULAR CHAMBER

[75] Inventors: Shigeru Akiike, Isesaki; Yuuji Rikukawa, Gunma, both of Japan

[73] Assignee: Sanden Corporation, Gunma, Japan

[21] Appl. No.: 315,575

[22] Filed: Feb. 27, 1989

[30] Foreign Application Priority Data

Feb. 26, 1988 [JP] Japan ..... 63-42319

[51] Int. Cl.[5] ..... F25D 21/06

[52] U.S. Cl. ..... 62/81; 62/82; 62/156; 62/155; 62/278; 62/282

[58] Field of Search ..... 62/278, 277, 196.4, 62/81, 155, 156, 151, 234, 182, 282, 82

[56] References Cited

U.S. PATENT DOCUMENTS 3,273,635 9/1966 Jobes ..... 62/155 X
3,461,681 8/1969 Smith et al. ..... 62/234 X
4,178,767 12/1979 Shaw ..... 62/155

FOREIGN PATENT DOCUMENTS 0213540 8/1986 European Pat. Off. .
3441912-A1 11/1984 Fed. Rep. of Germany .
57-174641 10/1982 Japan .
58-28937 2/1983 Japan .

*Primary Examiner*—Harry B. Tanner
*Attorney, Agent, or Firm*—Banner, Brich, McKie & Beckett

[57] ABSTRACT

A method of defrosting a refrigerating circuit for use in cooling a vehicular chamber comprises two steps. In a first step a frost formed at an outer surface of an evaporator of a cooling unit is defrosted by directly leading discharged gas to the evaporator. In a second step a frost formed at elements of the cooling unit except the evaporator is defrosted by making air in the vehicular chamber pass through the heated evaporator. In this manner, the cooling down characteristic in the vehicular chamber is improved and compressor durability is preserved.

12 Claims, 4 Drawing Sheets

METHOD OF DEFROSTING A REFRIGERATING CIRCUIT FOR USE IN COOLING A VEHICULAR CHAMBER

BACKGROUND OF THE INVENTION

1. Field of the Invention

This invention relates to a refrigerating circuit used for cooling a vehicle, and more particularly, to a method of defrosting the refrigerating circuit.

2. Description of the Prior Art

With reference to FIG. 1, a refrigerating circuit 10 generally used for cooling a vehicle is schematically shown. Refrigerating circuit 10 includes compressor 11, condenser 12 and cooling unit 13 disposed within the environs of a vehicle to be cooled (not shown). Of course, the vehicle to be cooled may be an automobile, a truck, a bus, a plane or other mobile apparatus having a passenger or other compartment to be cooled. Compressor 11 is providing with electromagnetic clutch 111 for intermittently transferring the dynamic power of an engine (not shown) of the vehicle to compressor 11. Cooling unit 13 comprises evaporator 131, evaporator motor fan 132, and a casing disposing evaporator 131 therewithin (symbolically shown by a broken line). Conduits 14, 15, 16 normally connect compressor 11 and condenser 12, condenser 12 and evaporator 131, and evaporator 131 and compressor 11 respectively. Condenser 12 condenses refrigerant gas discharged from compressor 11. Condenser motor fan 121 is disposed near condenser 12 and makes air outside of the vehicle pass through condenser 12. Expansion valve 17 is disposed between condenser 12 and evaporator 131 in conduit 15 and expands condensed refrigerant flowing from condenser 12. Evaporator motor fan 132 is disposed near evaporator 131 and causes air in the vehicular chamber to be cooled to pass through evaporator 131. Consequently, the vehicular chamber is cooled. Bypass conduit 18 connects conduit 14 and that portion of conduit 15 located between expansion valve 17 and evaporator 131. Solenoid valve 19 located in bypass conduit 18 selectively bypasses the refrigerant gas discharged from compressor 11 directly to evaporator 131.

According to the prior art, defrosting a frost formed at cooling unit 13 is carried out via bypass conduit 18. When a refrigerating control apparatus (not shown) including a defrosting control system receives a signal requesting a defrosting of a frost formed at cooling unit 13, refrigerant gas discharged from compressor 11 is directly bypassed to evaporator 131 by operation of solenoid valve 19. Bypassing discharged refrigerant gas to evaporator 131 is continued until a predetermined period of time has lapsed. When the predetermined period of time elapses, refrigerant gas flows again into condenser 12 by operation of solenoid valve 19. Accordingly, defrosting a frost formed at cooling unit 13 is terminated and cooling of the vehicular chamber begins again.

Furthermore, in another known type of defrosting control system, defrosting a frost formed at cooling unit 13 is terminated when the temperature of an outer surface of evaporator 131 increases to a predetermined value.

However, according to the above-mentioned prior art method, each frost formed at the evaporator 131, the motor fan 132, the casing and a drain pipe for the casing are defrosted only by leading discharged refrigerant gas into the evaporator so that the time which has elapsed of leading discharged refrigerant gas into the evaporator may be prolonged. Accordingly, remarkably raising a temperature in the vehicular chamber to be cooled causes an inferior cooling down characteristic of the cooling unit of the vehicular chamber. Furthermore, the durability of the compressor is reduced by compressing the discharged refrigerant gas over prolonged period.

SUMMARY OF THE INVENTION

It is a primary object of this invention to provide an improved defrosting method of a refrigerating circuit which is used for cooling a vehicular chamber.

It is a further object of the present invention to improve the cooling down characteristic in the vehicular chamber to be cooled and decrease any loss in compressor durability.

A refrigerating circuit used for cooling a vehicular chamber includes a compressor, a condenser, an expansion valve, a cooling unit and a controlled valve member. The condenser condenses refrigerant gas discharged from the compressor. The expansion valve expands condensed refrigerant flowing from the condenser. The cooling unit comprises an evaporator and a fan and is disposed within the environs of the vehicular chamber to be cooled. The controlled valve member selectively switches a course of flow of the discharged refrigerant gas in order to directly lead the discharged refrigerant gas to the evaporator by passing the condenser and the expansion valve. A fan of the cooling unit makes air of the vehicular chamber pass through the evaporator.

A method for defrosting a frost formed at the cooling unit comprises first and second steps. In the first step, a frost formed at an outer surface of the evaporator is defrosted by means of directly leading the discharged refrigerant gas to the evaporator. In the second step, a frost formed at elements of the cooling unit except the evaporator is defrosted by means of making air of the vehicular chamber pass through the evaporator.

DETAILED DESCRIPTION OF THE PREFERRED EMBODIMENT

Figure 1:
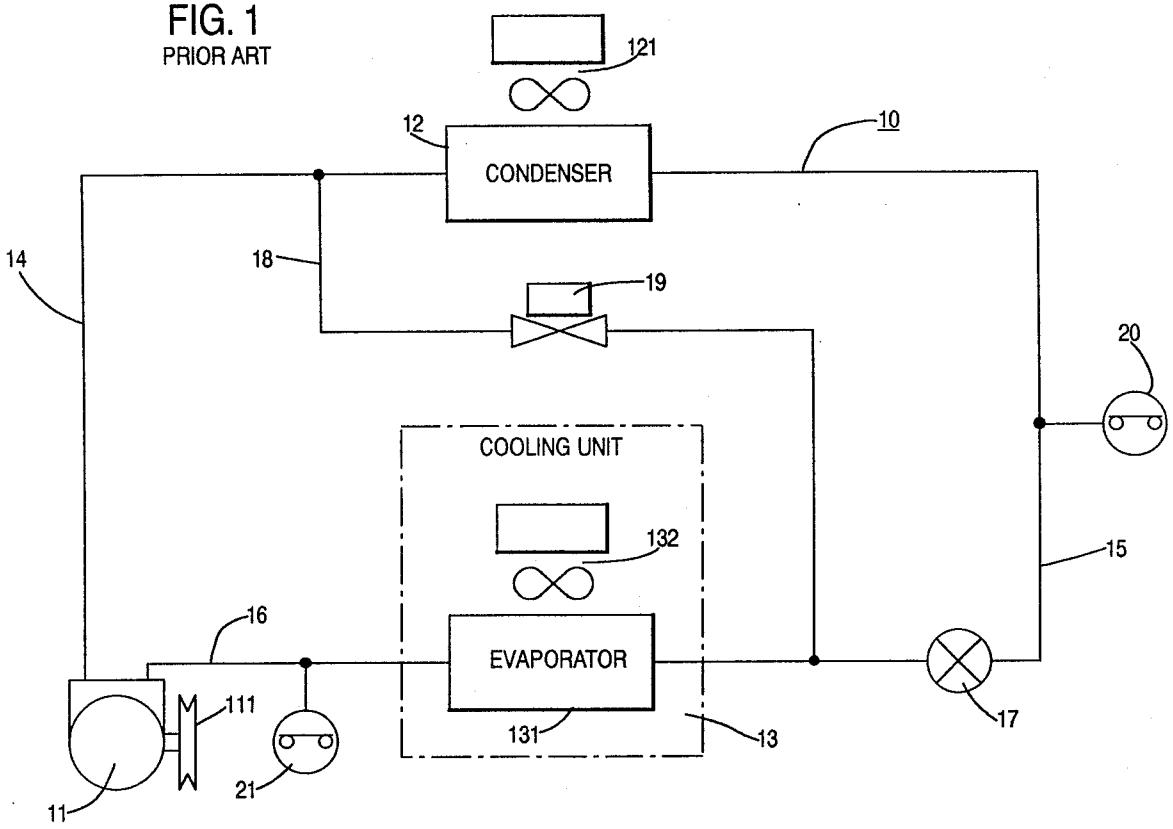
FIG. 1 PRIOR ART
FIG. 1 is a schematic block diagram of a refrigerating circuit generally used for cooling a vehicular chamber.
Figure 2:
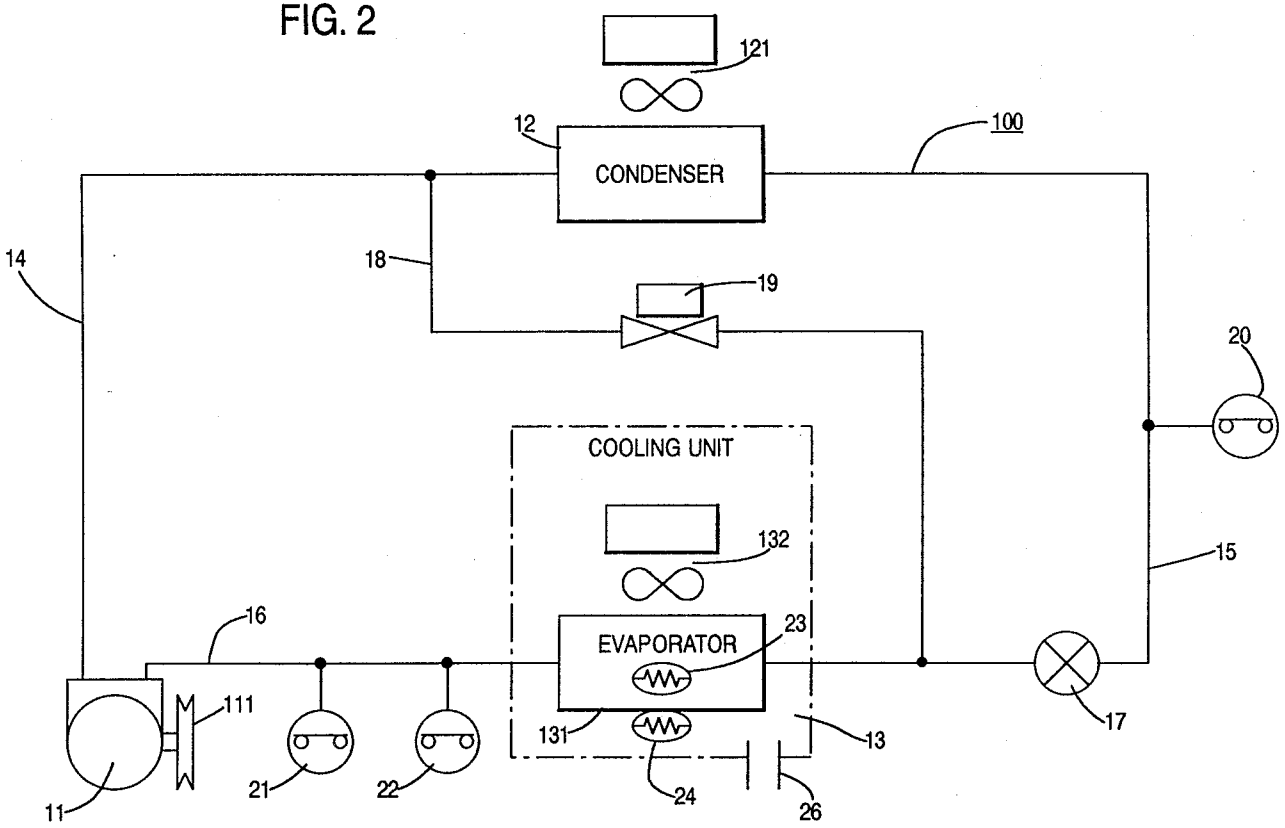
FIG. 2 is a schematic block diagram of a refrigerating circuit used for cooling a vehicular chamber in accordance with one embodiment of the present invention.

With reference to FIG. 2, refrigerating circuit 100 used for cooling a vehicular chamber is schematically shown. In the drawing the same reference numerals are used to denote the corresponding elements shown in FIG. 1. However, in addition to the elements similarly depicted and labeled in FIG. 1, refrigerating circuit 100 includes pressure switch 22 and first and second thermal sensors 23 and 24. Pressure switch 22 is connected in conduit 16 in a similar manner to super heat switch 21. First and second thermal sensors 23 and 24 sense temperature of a fin of evaporator 131 and temperature of air leaving from evaporator 131 respectively. Refrigerating circuit 100 further includes third thermal sensor 25 shown in the below-described FIG. 3. Third thermal sensor 25 senses temperature of air in the vehicular chamber to be cooled. A drain pipe member 26 of cooling unit 13 is shown for draining condensed water from cooling unit 13.

Figure 3:
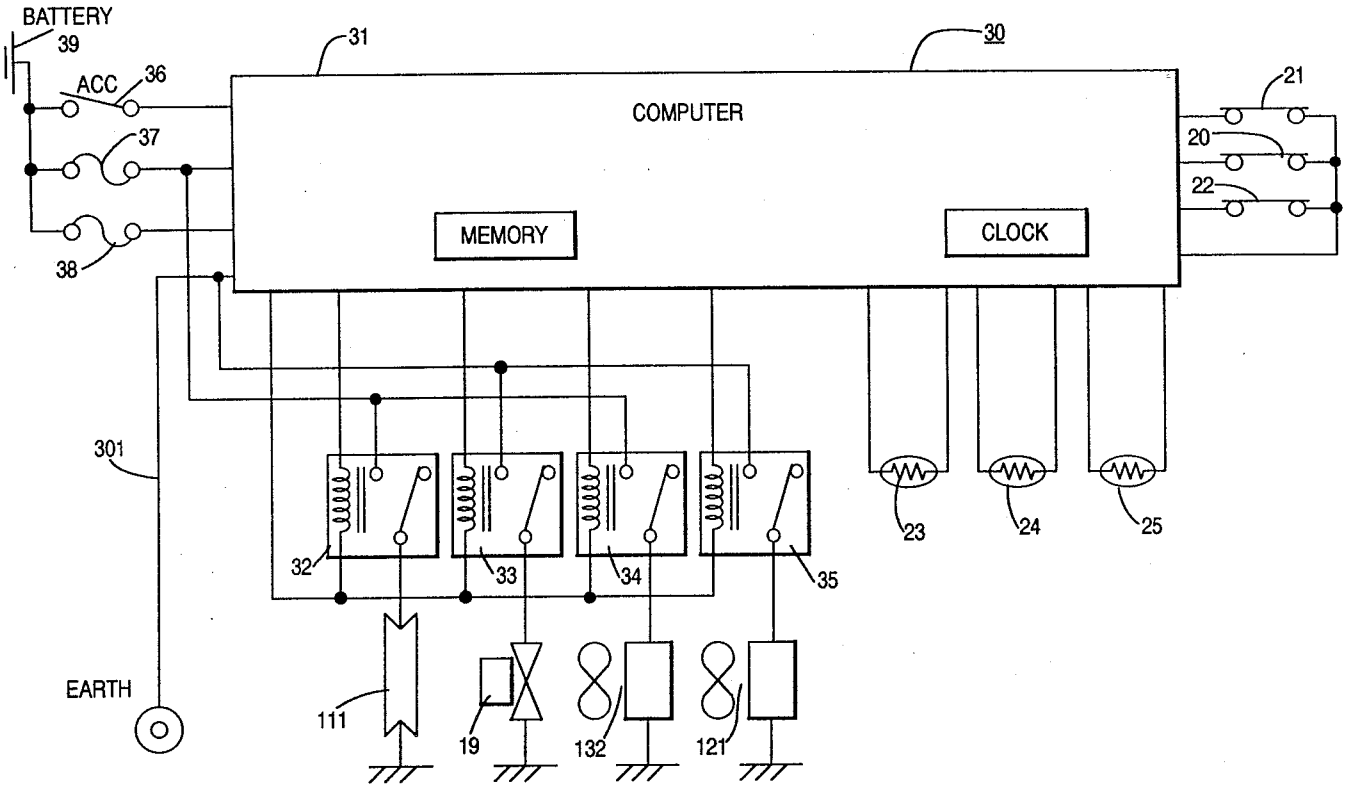
FIG. 3 is a schematic circuit diagram of a refrigerating control apparatus of a refrigerating circuit in accordance with one embodiment of the present invention.

With reference to FIG. 3, a schematic circuit diagram of refrigerating control apparatus 30 of a refrigerating circuit in accordance with one embodiment of the present invention is shown. Refrigerating control apparatus 30 comprises computer 31 which most conveniently comprises a microcomputer connected to first, second and third thermal sensors 23, 24 and 25, high pressure switch 20, super heat switch 21 and pressure switch 22, all of which send an input signal representing sensed data for predetermined levels to computer 31. Furthermore, computer 31 is provided with an internal or external clocking or counting means by which real time between events may be calculated and a memory for storing programs or data. First, second, third and fourth solenoid switches 32, 33, 34 and 35 are also connected to computer 31. Accessory switch 36 and first and second fuses 37 and 38 connect computer 31 in parallel to power supply 39 which may be most conveniently a direct current battery of the vehicle. Each terminal end of electromagnetic clutch 111 and evaporator motor fan 132 connect to a wire protected by the first fuse 37 through first and third solenoid switches 32 and 34 respectively. Each terminal end of solenoid valve 19 and condenser motor fan 121 connect to a wire protected by the second fuse 38 through second and fourth solenoid switches 33 and 35 respectively. Computer 31 is connected to electrical ground EARTH via a body of the vehicle through wire 301.

In operation, when first solenoid switch 32 is turned on by receiving an actuation signal from computer 31, electromagnetic clutch 11 begins its operation to drive compressor 11. When second solenoid switch 33 is turned on by receiving an actuation signal from computer 31, solenoid valve 19 is opened to bypass discharged refrigerant gas directly to evaporator 131. When third solenoid switch 34 is turned on by receiving an actuation signal from computer 31, evaporator motor fan 132 begins its operation to cause air in the vehicular chamber to pass through evaporator 131. When fourth solenoid switch 35 is turned on by receiving an actuation signal from computer 31, condenser motor fan 121 begins its operation to make outside air exterior of the vehicle pass through condenser 12. On the other hand, when first solenoid switch 32 is turned off by receiving a deactuation signal from computer 31, electromagnetic clutch 111 terminates its operation thus terminating the operation of compressor 11. When second solenoid switch 33 is turned off by receiving a deactuation signal from computer 31, solenoid valve 19 is closed causing discharged refrigerant gas to flow via condenser 12 and expansion valve 17 to cooling 13. When third solenoid switch 34 is turned off by receiving a deactuation signal from computer 31, evaporator motor fan 132 terminates its operation. When fourth solenoid switch 35 is turned off by receiving a deactuation signal from computer 31, condenser motor fan 121 terminates its operation.

Furthermore, when the pressure at an outlet portion of evaporator 131 exceeds, for example, 18kg/cm G, pressure switch 22 sensing the pressure at the outlet portion of evaporator 131 turns off. Accordingly, an actuating signal for the signal for the pressure sent to computer 31 is removed.

Figure 4:
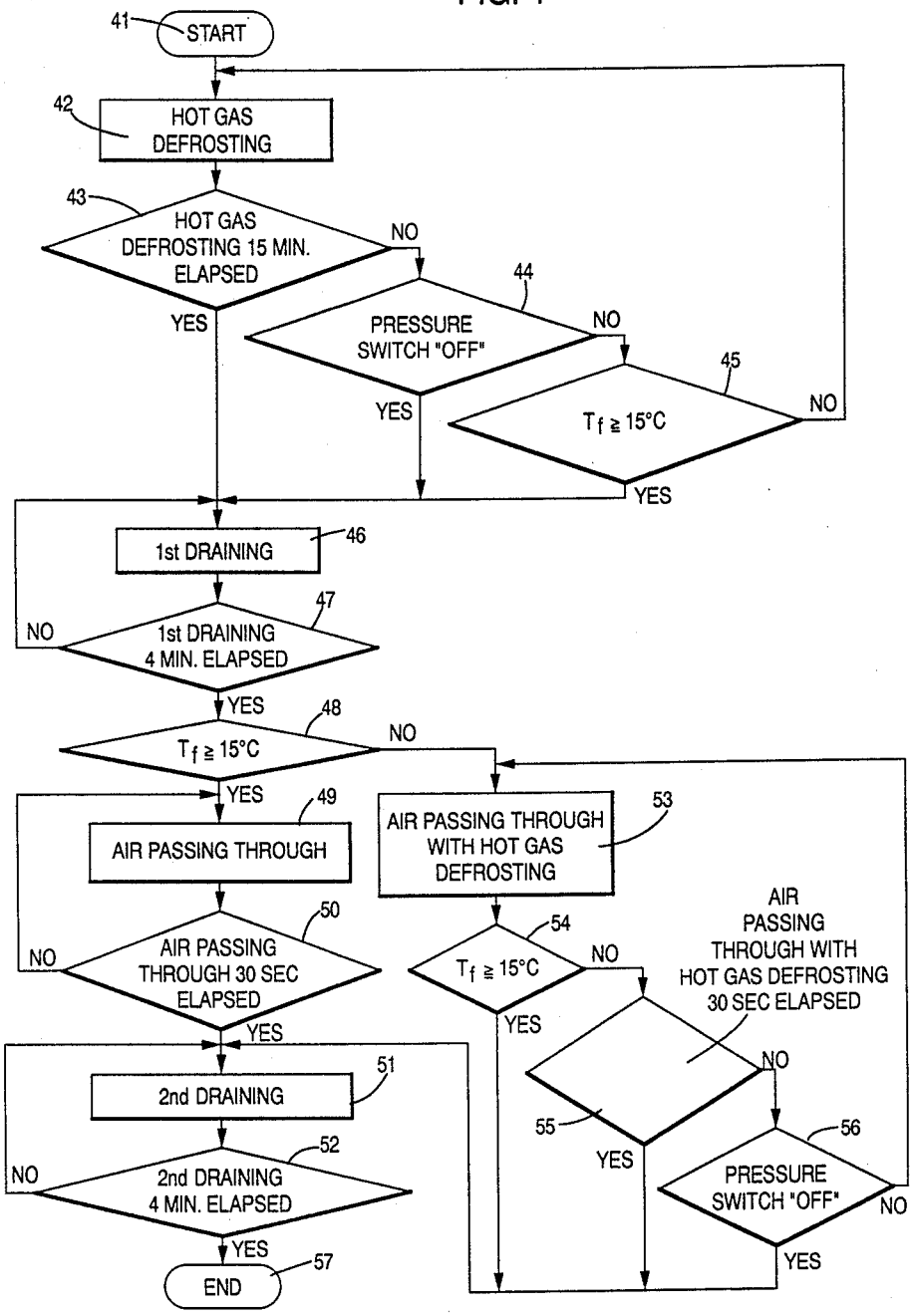
FIG. 4 is a flow chart of a defrosting method of a refrigerating circuit in accordance with one embodiment of the present invention.

With reference to FIG. 4, a flow chart of a defrostng method of a refrigerating circuit in accordance with one embodiment of the present invention is shown. The defrosting control method includes the following steps. When computer 31 receives a defrosting command signal in either an automatic defrosting mode or a manual defrosting mode of operation at start step 41, a hot gas defrosting, i.e., mainly defrosting a frost formed at an outer surface of evaporator 131 by means of leading the discharged refrigerant gas directly to evaporator 131 at step 42 is begun by turning on solenoid switches 32, 33 and 35 and turning off solenoid switch 34. Step 43 judges whether the duration of hot gas defrosting has occurred over a predetermined period of, for example, 15 minutes or not. If the hot gas defrosting has lasted 15 minutes, step 43 proceeds to step 46. If hot gas defrosting has not lasted 15 minutes, step proceeds to step 44. Step 44 judges whether pressure switch 22 is turned off. If the pressure switch 22 is off, step 44 proceeds to step 46. If pressure switch 22 is not off, step 44 proceeds to step 45. Step 45 compares Tf, i.e., a temperature of a fin of evaporator 131 measured at first thermal sensor 23, with 15° C. as a suggested predetermined value. If Tf is equal to or higher than 15° C., step 45 proceeds to step 46. While Tf is lower than 15° C., step 45 flows back to step 42 and hot gas defrosting continues.

At step 46, a first draining, i.e., mainly a draining of the condensed water at the outer surface of evaporator 131 by drain member 26, is begun by turning off solenoid switches 32, 33 and 34 and maintaining solenoid switch 35 in an on state.

With respect to step 44 and step 45, step 44 more effectively than step 45 prevents an overload operation of compressor 11 due to compressing excessively high temperature refrigerant gas. Because the pressure in conduit 16 usually reaches 18kg/cm G faster than the temperature of the fin of evaporator 131 reaches 15° C., compressor 11 is turned off earlier by step 44 than by step 45 to provide a margin of safety in the structure of flowchart FIG. 4. Furthermore, the above-mentioned relation between steps 44 and 45 can more effectively prevent an overload operation of compressor 11 during a high speed rotation of compressor 11.

Step 47 judges whether the first draining has lasted, for example, 4 minutes. If the first draining has lasted 4 minutes, step 47 proceeds to step 48. If the first draining has not lasted 4 minutes, step 47 flows back to step 46 to continue draining of water. Step 48 compares Tf with 15° C. If Tf is equal to or higher than 15° C., step 48 proceeds to step 49. If Tf is lower than 15° C., step 48 proceeds to step 53. At step 49, an "air passing through" defrosting step, i.e., mainly defrosting a frost formed at elements of cooling unit 13 except evaporator 131 by causing air in the vehicular chamber to pass through the evaporator, begins by turnng off solenoid switches 32 and 33 and turning on solenoid switches 34 and 35. Step 50 judges whether the air passing through defrosting step has lasted for a predetermined period of, for example 30 seconds. If the air passing through step has lasted 30 seconds, step 50 proceeds to step 51. If the air passing through step has not lasted 30 seconds, step 50 flows back to step 49 and the air continues to pass through evaporator 131. At step 53, an air passing through with hot gas defrosting, i.e., mainly defrosting a frost formed at cooling unit 13 except evaporator 131 by causing air in the vehicular chamber to pass through evaporator 131 and also, at the same time, directly leading the discharged refrigerant gas to evaporator 131, begins by turning on all solenoid switches 32, 33, 34 and 35. At step 54 Tf is compared with 15° C. If Tf is equal to or higher than 15° C., step 54 proceeds to step 51. If Tf is lower than 15° C., step 54 proceeds to step 55. Step 55 judges whether the air passing through with hot gas defrosting has lasted 30 seconds. If the air passing through with hot gas defrosting has lasted 30 seconds, step 55 proceeds to step 51.

If the air passing through with hot gas defrosting has not lasted 30 seconds, step 55 proceeds to step 56. Step 56 judges whether pressure switch 22 is off. If pressure switch 22 is off, step 56 proceeds to step 51. If pressure switch 22 has not turned off, step 56 flows back to step 53. At step 51, a second draining i.e., draining condensed water at the cooling unit 13 by pipe member 26 except evaporator 131, is begun by turning off solenoid switches 32, 33 and 34 and turning on solenoid switch 35. Step 52 judges whether the second draining has lasted a predetermined period of, for example 4 minutes. If the second draining has not lasted 4 minutes, step 52 flows back to step 51. If the second draining has lasted for 4 minutes, step 52 proceeds to end of defrosting step 57. Accordingly, the present defrosting method is terminated.

Furthermore, the automatic defrosting mode includes two types of defrosting. One type is in cyclic defrosting and the other type is a defrosting with a frost detector. Each type begins upon the occurrence of different conditions. The in cyclic defrosting type of defrosting begins on the condition that 2 hours or more has elapsed after accessory switch 36 is turned on or after all the steps of the defrosting of a frost formed at cooling unit 13 have terminated and Tf is lower than a predetermined temperature of air in the vehicular chamber Tc plus 5° C. On the other hand, when 10 minutes or more has elapsed after accessory switch 36 has turned on or after all the steps of defrosting a frost formed at cooling unit 13 are terminated, Tf is lower than 0° C., and To i.e., the temperature of air leaving evaporator 131 is lower than the temperature of air in the vehicular chamber by 9K, defrosting of the frost detector type begins independently of the above-mentioned conditions associated with defrosting of the cyclic type. When a manual defrosting mode is switched from manual to the automatic defrosting mode, defrosting a frost formed at cooling unit 13 is automatically begun when the above-mentioned conditions are satisfied. In the manual defrosting mode, computer 31 neglects a defrosting signal generated by turning on a defrosting switch (not shown) while a defrosting of a frost formed at cooling unit 13 is proceeding.

Thus a two step method of defrosting a refrigerating cicruit has been described which meets the objectives sought. Advantageous combinations of sub-steps of the defrosting method described by the flowchart of FIG. 4 would be obvious to one of skill in the art following the principles of the present invention and are described above by the claims which follow.

We claim:

1. In a refrigerating circuit for use in cooling a vehicular chamber including a compressor, a condenser for condensing refrigerant gas discharged from said compressor, an expansion valve for expanding condensed refrigerant flowing from said condenser, a cooling unit having an evaporator and a fan disposed within the vehicular chamber to be cooled, and a controlled valve member for selectively switching a course of a flow of refrigerant gas discharged from said compressor in order to directly lead said discharged refrigerant gas to said evaporator, said fan for causing air in said vehicular chamber to pass through said evaporator, a method for defrosting a frost formed at said cooling unit comprising a first step of defrosting a frost formed at an outer surface of said evaporator by directly leading said discharged refrigerant gas to said evaporator and a second step of defrosting a frost formed at said cooling unit in addition to said evaporator by causing air in the vehicular chamber to pass through said evaporator, said first step being initiated when a command signal for defrosting a frost formed at said cooling unit is generated, said first step being terminated at the earlier point in time either of when the duration of operation of said first step exceeds a first predetermined period of time or when a temperature of an outer surface of said evaporator reaches or exceeds a predetermined value, said second step being initiated in operation after said first step is terminated, said second step being terminated when the duration of operation of said secnd step exceeds a second predetermined period of time.

2. The method of claim 1 further comprising the step of draining condensed water from said cooling unit by a pipe member.

3. The method of claim 2 said second step defrosting a frost formed at said fan, said pipe member, and a casing of the cooling unit by causing air in said vehicular chamber to pass through said evaporator.

4. The method of claim 2, said second step defrosting a frost formed at said fan, said pipe member, and a casing of the cooling unit by causing air in said vehicular chamber to pass through said evaporator simutaneously with directly leading said discharged refrigerant gas to said evaporator.

5. The method of claim 1, said step of causing air to pass through said evaporator being accomplished by said fan drawing air through said evaporator.

6. In a refrigerating circuit for use in cooling a vehicula chamber including a compressor, a condenser for condensing refrigerant gas discharged from said compressor, an expansion valve for expandng condensed refrigerant flowing from said condenser, a cooling unit having an evaporator and a fan disposed within the vehicular chamber to be cooled, and a controlled valve member for selectively switching a course of a flow of refrigerant gas discharged from said compressor in order to directly lead said discharged refrigerant gas to said evaporator, said fan for causng air in said vehicular chamber to pass through said evaporator, a method for defrosting a frost formed at said cooling unit comprising a first step of defrosting a frost formed at an outer surface of said evaporator by directly leading said discharged refrigerant gas to said evaporator and a second step of defrosting a frost formed at said cooling unit in addition to said evaporator by causing air in the vehicular chamber to pass through said evaporator, said first step being initiated when a command signal for defrosting a frost formed at said cooling unit is generated, said first step being terminated at the earliest point in the time among when the duration of operation of said first step exceeds a first predetermined period of time or when temperature of an outer surface of said evaporator reaches or exceeds a predetermined value or when pressure in an outlet portion of said evaporator reaches a predetermined value, said second step being initiated after said first step is terminated, said second step being terminated when the duration of operation of said second step exceeds a second predetermined value.

7. In a refrigerating circuit for use in cooling a vehicular chamber including a compessor, a condenser for condensing refrigerant gas discharged from said compressor, an expansion valve for expanding condensed refrigerant flowing from said condenser, a cooling unit having an evaporator and a fan disposed within the vehicular chamber to be cooled, and a controlled valve member for selectively switching a course of a flow of refrigerant gas discharged from said compressor in order to directly lead said discharged refrigerant gas to said evaporator, said fan for causing air in said vehicular chamber to pass through said evaporator, a method for defrosting a frost formed at said cooling unit comprising a first step of defrosting a frost formed at an outer surface of said evaporator by directly leading said discharged refrigerant gas to said evaporator and a secon step of defrosting a frost formed at said cooling unit by causing air in said vehicular chamber to pass through said evaporator simultaneously with directly leading said discharged refrigerant gas to said evaporator, said first step being initiated when a command signal for defrosting a frost formed at said cooling unit is generated, said first step being terminated at the earlier point in time of when the duration of operation of said first step exceeds a first predetermined time or when temperature of an outer surface of said evaporator reaches or exceeds a predetermined value, said second step being initiated after said first step is terminated, said second step being terminated at the earliest point in time among when duration of operation of said second step exceeds a second predetermined period of time or when temperature of an outer surface of said evaporator reaches the predetermined value or when pressure in an outlet portion of said evaporator reaches a predetermined value.

8. The method of claim 7 further comprises the step of draining condensed water from said cooling unit by a pipe member.

9. The method of claim 8, said second step defrosting a frost formed at said fan, said pipe member, and a casing of the cooling unit by causing air in said vehicular chamber to pass through said evaporator.

10. The method of claim 8 said second step defrosting a frost formed at said fan, said pipe member, and a casing for said cooling unit by means of causing air in said vehicular chamber to pass through said evaporator simultaneously with directly leading said discharged refrigerant gas to said evaporator.

11. The method of claim 7, said step of causing air to pass through said evaporator being accomplished by said fan for drawing air through said evaporator.

12. In a refrigerating circuit for use in cooling a vehicular chamber including a compressor, a condenser for condensing refrigerant gas discharged from said compressor, an expansion valve for expanding condensed refrigerant flowing from said condenser, a cooling unit having an evaporator and a fan disposed within the vehicular chamber to be cooled, and a controlled valve member for selectively switching a course of a flow of refrigerant gas discharged from said compressor in order to directly lead said discharged refrigerant gas to said evaporator, said fan for causing air in said vehicular chamber to pass through said evaporator, a method for defrosting a frost formed at said cooling unit comprising a first step of defrosting a frost formed at an outer surface of said evaporator by directly leading said discharged refrigerant gas to said evaporator and a second step of defrosting a frost formed at said cooling unit by causing air in vehicular chamber to pass through said evaporator simultaneously with directly leading said discharged refrigerant gas to said evaporator, said first step being initiated when a command signal for defrosting a frost formed at said cooling unit is generated, said first step being terminated at the earliest point in time among when duration of operation of said first step exceeds a first predetermined period of time or when temperature of an outer surface of said evaporator reaches a predetermined value or when pressure in an outlet portion of said evaporator reaches a predetermined value, said second step initiated after said first step is terminated, said second step being terminated at the earliest point in time among when duration of operation of said second step exceeds a second predetermined period of time or when temperature of an outer surface of said evaporator reaches the predetermined value or when pressure in an outlet portion of said evaporator reaches the predetermined value.

* * * * *